US005112264A

United States Patent [19]

Ning et al.

[11] Patent Number: 5,112,264

[45] Date of Patent: May 12, 1992

[54] INSERT CONNECTING TOY

[75] Inventors: Sun Y. Ning; Fan L. Huan, both of Nanjing, China

[73] Assignee: Nanjing Jingcheng Patent Technique Development Company, China

[21] Appl. No.: 728,330

[22] Filed: Jul. 8, 1991

Related U.S. Application Data

[63] Continuation of Ser. No. 563,717, Aug. 7, 1990, abandoned.

[30] Foreign Application Priority Data

Aug. 8, 1989 [CN] China ..... 89-2052945

[51] Int. Cl.[5] ..... A63H 33/08

[52] U.S. Cl. ..... 446/108; 446/127

[58] Field of Search ..... 446/127, 108, 109, 105, 446/106, 97, 98, 100, 101

[56] References Cited

U.S. PATENT DOCUMENTS

| | | | |
|---|---|---|---|
| 2,036,302 | 4/1936 | Salazar | 446/100 |
| 2,377,572 | 6/1945 | Pedersen | 446/108 X |
| 2,674,827 | 4/1954 | Schaper | 446/100 |
| 3,852,909 | 12/1974 | Viebcke | 446/125 X |
| 4,529,385 | 7/1985 | Riener et al. | 446/101 X |
| 4,895,543 | 1/1990 | Vermette | 446/105 |

FOREIGN PATENT DOCUMENTS

| | | | |
|---|---|---|---|
| 1002115 | 3/1952 | France | 446/99 |
| 1044887 | 11/1953 | France | 446/99 |
| 155183 | 12/1920 | United Kingdom | 446/99 |
| 1240878 | 7/1971 | United Kingdom | 446/101 |

*Primary Examiner*—Robert A. Hafer
*Assistant Examiner*—D. Neal Mair
*Attorney, Agent, or Firm*—Shoemaker and Mattare, Ltd.

[57] ABSTRACT

An insert-connecting toy which is insert-connected by several irregular construction units, in which, said construction units are dividing into meta-elements and sub-elements; the thickness of the thinnest sub-element is taken as an unit thickness; and the thicknesses of the other sub-elements are integer number times the unit thickness; several grooves are arranged on the meta-element, and the width of said groove and the width of the laminate convex bank formed by said grooves are all integer number times the unit thickness; and several grooves are also arranged on at least one of the sub-elements, and the width of the groove and the width of the laminate convex bank formed by said grooves are also integer number times the unit thickness; and therefore a multiple insert-connecting model can be constructed. So said construction units can be insert-connected into stereo animal models which are lifelike in shape, vivid in mold-making and very attractive to children.

6 Claims, 6 Drawing Sheets

INSERT CONNECTING TOY

This application is a continuation of application Ser. No. 563,717, filed Aug. 7, 1990 now abandoned.

FIELD OF THE INVENTION

The present invention relates in general to toys and more particularly to an improved insert-connecting combination toy which can be combined into several types of three-dimensional and lifelike animal models.

BACKGROUND OF THE INVENTION

Most types of conventional insert-connecting combination toys are simple planar insert-connecting or plunger-hole types of toys which are difficult to construct into three-dimensional lifelike animal models, and are not very attractive to children.

SUMMARY OF THE INVENTION

Accordingly, the present invention provides a new kind of tongued-and-grooved multiple insert-connecting structure which can be used to construct several kinds of animal models, and more particularly to construct three-dimensional animal models. Summary of the invention The present invention provides an insert-connecting toy which is insert-connected by several irregularly shaped construction units, wherein, said construction units are divided into meta-elements and sub-elements. The thickness of the thinnest sub-element is defined as being a unit thickness, and the thicknesses of the other sub-elements are integer multiples of the unit thickness. Several grooves are arranged on the meta-element, and the width of each groove and the width of each laminate convex bank formed by the grooves is an integer number times the unit thickness. Several grooves are also arranged on at least one of the sub-elements, separated by respective lands. The width of each groove on the sub-elements and the width of each land formed between the grooves on the sub-element is also an integer number times the unit thickness, such that a multiple insert-connecting model can be constructed.

BRIEF DESCRIPTION OF THE DRAWINGS

The embodiments of the present invention are described hereinafter referring to the following drawings, in which.

DETAILED DESCRIPTION OF THE PREFERRED EMBODIMENT

Figure 1:
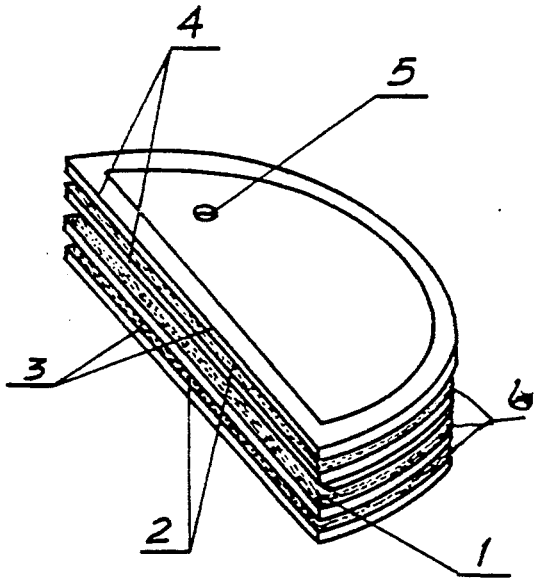
FIG. 1 is a perspective view of a grooved meta-element.

FIG. 1 illustrates a semicircular meta-element, on the side of which three grooves are arranged in the form of one middle groove 1 and two grooves 2 on either side of the groove 1. The width of the middle groove 1 is 4 mm, and the width of the other two grooves is 2 mm, and the depth of all three grooves is 5 mm. Four lands 3, 4 are provided which surround respective ones of the grooves 1, 2. The thickness of the four lands 3, 4 formed by the grooves are 2 mm. The diameter of circular hole 5 is 3 mm and its depth is 2 mm.

Figure 2:
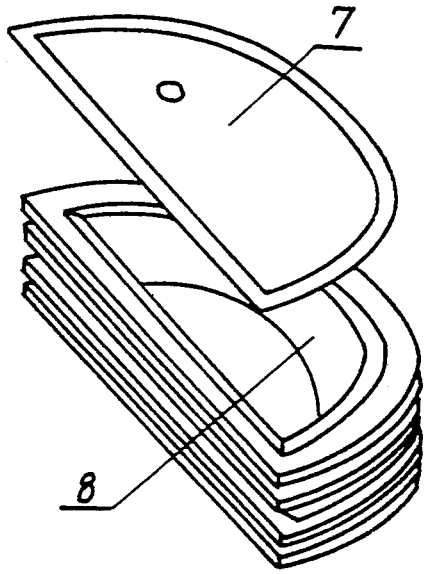
FIG. 2 is an exploded view of the meta-element shown in FIG. 1.

In FIG. 2, reference numeral 7 designates a box body of the meta-element. A hole 5 is provided in the box cover 8.

Figure 3:
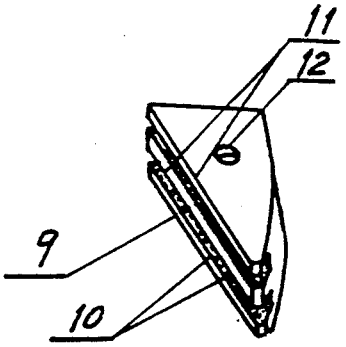
FIG. 3 is a perspective view of a first sub-element with grooves.

FIG. 3 illustrates a first type of sub-element, on one side of which are arranged two continuously closed and linear grooves 11. The width of the two grooves 11 is 2 mm and their depth is 5 mm. Three lands 9, 10 are formed to surround the grooves 11. The width of the middle land 9 is 4 mm and the width of the other two lands 10 is 2 mm. The diameter of circular hole 12 is 3 mm. and its depth is 2 mm.

Figure 4:
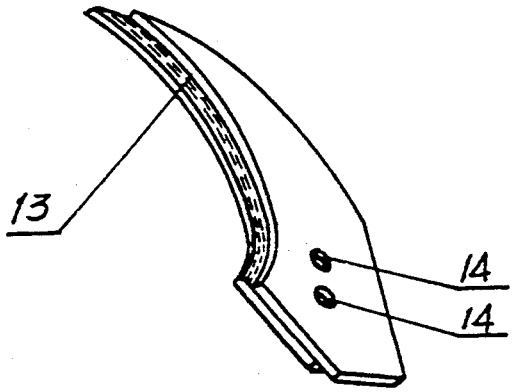
FIG. 4 is a perspective view of a combination sub-element constructed from a plurality of further sub-elements.

FIG. 4 illustrates a combination sub-element comprising two interconnected sub-elements 13 each 2 mm (shown in dashed lines). The diameter of each of two circular holes 14 is 3 mm and their depth is 2 mm.

Figure 5:
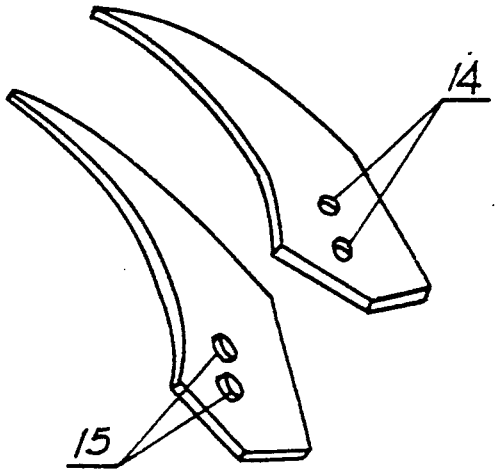
FIG. 5 is an exploded view of FIG. 4.

FIG. 5 is an exploded view of FIG. 4. Circular bosses 15 are shown which are adapted to interconnect with circular holes 14. The diameter of each boss 15 is 3 mm.

Figure 6:
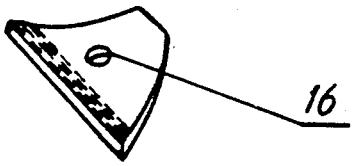
FIG. 6 is a perspective view of a sub-element with a circular hole.

FIG. 6 illustrates a further variety of of sub-element having a thickness of 2 mm, and provided with a hole 16 having a diameter of 3 mm.

Figure 7:
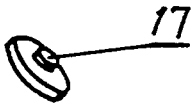
FIG. 7 is a perspective view of a sub-element with a circular boss.

FIG. 7 illustrates a circular sub-element provided with a circular boss 17. The diameter of the circular boss 17 is 3 mm and its height is 2 mm.

Thus, according to the preferred embodiment of the present invention, several irregular construction units are provided, as shown in FIGS. 1–7. The construction units are divided into meta-elements and sub-elements. The thickness of the thinnest sub-elements (e.g. shown in FIGS. 6 and 7) are defined as being a unit thickness, and the thicknesses of the other sub-elements are an integer number times the unit thickness. Several grooves 1, 2 are arranged on the meta-element of FIGS. 1 and 2, and the width of each groove and the width of the lands 3, 4 surrounding the grooves 1, 2 are all an integer number times the unit thickness.

Several grooves 1 are also arranged on the sub-element shown in FIG. 2, and the width of each groove and the width of the lands 9 and 10 surrounding the grooves are also an integer number times the unit thickness. The grooves 1, 2 and 11 are preferably arranged on the sides of the construction unit to form continuously closed grooves, or alternatively can be arranged to form grooves in sections, and can also be arranged on the front or the reverse side of the construction unit.

To make the insert-connecting of meta-elements and sub-elements easy, it is preferred that each groove of the meta-elements is linear or that its side projection is linear (i.e. one groove is on the same plane as the sub-element to be connected thereto). The width of the grooves 1, 2 is consistent with the lands of the sub-elements so as to fit tightly during insert-connecting.

One or more of the grooves 1, 2 which thicknesses are an integer number times the unit thickness, are adapted to receive two or three sub-elements such as shown in FIGS. 3–7, each cooperating land of the sub-elements having unit thickness. The width of the lands 3 and 4 formed by the grooves 1, 2 must be also consistent with the thickness of the sub-elements, so that further sub-elements can be inserted into the groove formed by two sub-elements which have already been inserted in two adjacent grooves 1, 2 of the meta-elements.

As discussed above, one or more circular blind holes or through holes such as 5, 12, 14 and 16 are arranged at suitable positions on predetermined ones of the construction units, and one or more circular bosses such as 15 and 17, having diameters which are the same as those of the holes, are arranged at suitable positions on other ones of the construction units (i.e. meta-elements and sub-elements). The circular holes are adapted to receive the circular bosses for interconnection of meta-elements and sub-elements. By means of this insert-connecting method, two sub-elements can be interconnected to construct a compound sub-element. In this way, a pair of compound sub-elements which are the same as each other in shape and symmetrical on the left side and the right side may be interconnected via the surfaces thereof which do not contain holes, such that a groove is formed therebetween.

The sub-elements can be inserted into the meta-element directly, and can also be insert-connected with the meta-element by means of intermediate sub-elements forming compound sub-elements. By means of this method of construction, one-stage two-stage or three-stage insert-connecting can be done, wherein each stage can adopt any of several different formations. For example, two symmetrical sub-elements can be inserted into the middle groove 1 of the meta-element simultaneously so as to form a head or a tail or a mouth or a horn etc. of an animal, and where two symmetrical sub-elements are inserted into the left side groove and the right side groove of the meta-element respectively, they can form legs or ears or teeth or wings, etc. of an animal. A pair of circular laminate sub-elements such as depicted in FIG. 7 can be inserted into the meta-element to form a pair of eyes of an animal.

In order to increase the friction force of insert-connecting, the tenoning surfaces between construction units can be made rough or can be provided with several convex lines, bosses etc.

In FIG. 1 to FIG. 7, the sections shown by dash lines indicate the tenoning surfaces of the construction units, which are arranged with minute convex bosses so as to form rough tenoning surfaces. The height of each minute convex boss is less than 0.1 mm.

The edges (including the edges (6) of the lands) of each construction unit are all preferably chamfered by circular beading so as to prevent the construction units from scratching the hands of the user and also to provide a guiding function during insert-connecting of the unit. The areas shown by dashed lines in FIG. 1 depict the location of the circular beading.

The cross-section of the groove 1, 2, 11 etc. can be rectangular, and can also be trapezoidal (i.e. incorporating a small taper: the bottom of the groove being slightly wider than the mouth of the groove) so as to make the insert-connecting tight fitting. The meta-element (FIGS. 1 and 2) is made of a ducted boss-type structure (e.g. box 8), in which a sounder may be inserted so as to increase amusement value of the toy.

To increase insert-connecting types, several cylinder units may be provided as discussed below with reference to FIG. 10, having diameters which are the same as those of the circular holes the other construction units. Such a cylinder unit may be inserted into two construction units simultaneously so that two construction units can be insert-connected together.

Figure 8:
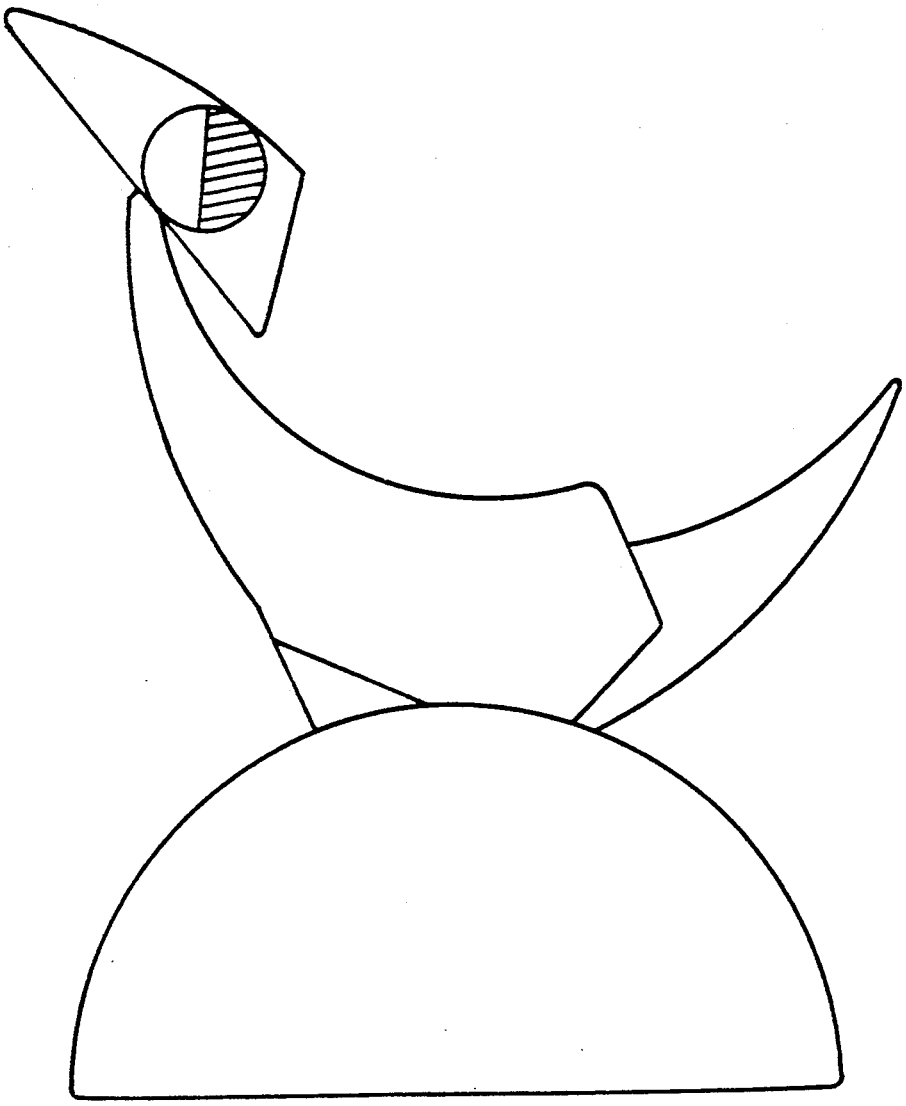
FIG. 8 to FIG. 11 are views of various constructions of meta-elements and sub-elements combined to form representations of animal figures.

FIG. 8 is an external view of a first insert-connected embodiment in the form of a small deer according to the principles of the present invention, as discussed above.

Figure 9:
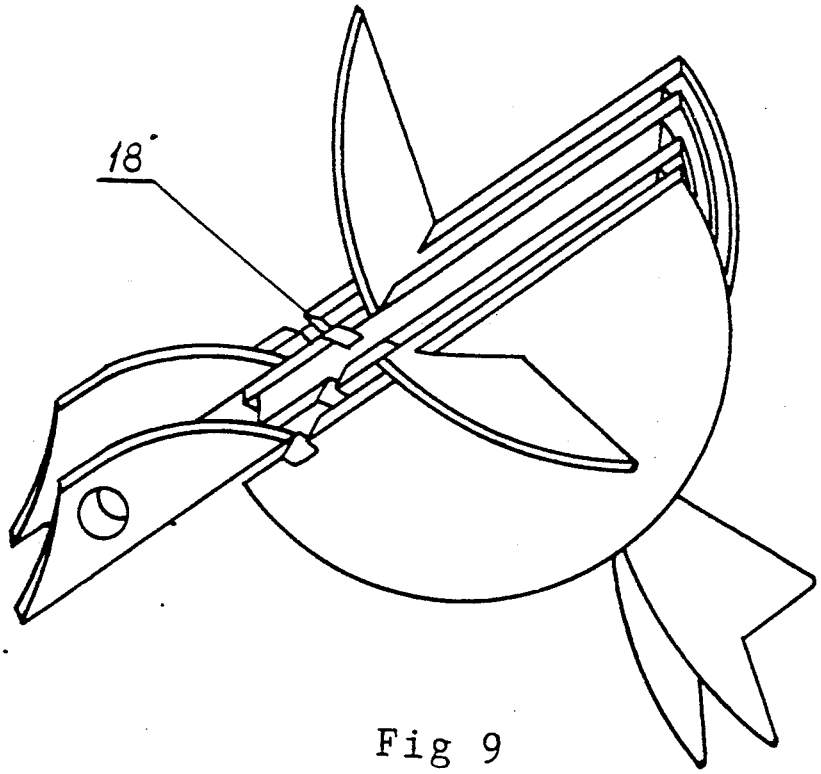

FIG. 9 illustrates a second embodiment, which essential structure is basically similar to that of the first embodiment. The difference is that oblique grooves 18 are arranged on two parallel sides of the meta-element. The thickness of the oblique grooves is an integer number times the unit thickness. A pair of oblique sub-elements are shown inserted into the oblique grooves 18 so as to embellish the animal model.

Figure 10:
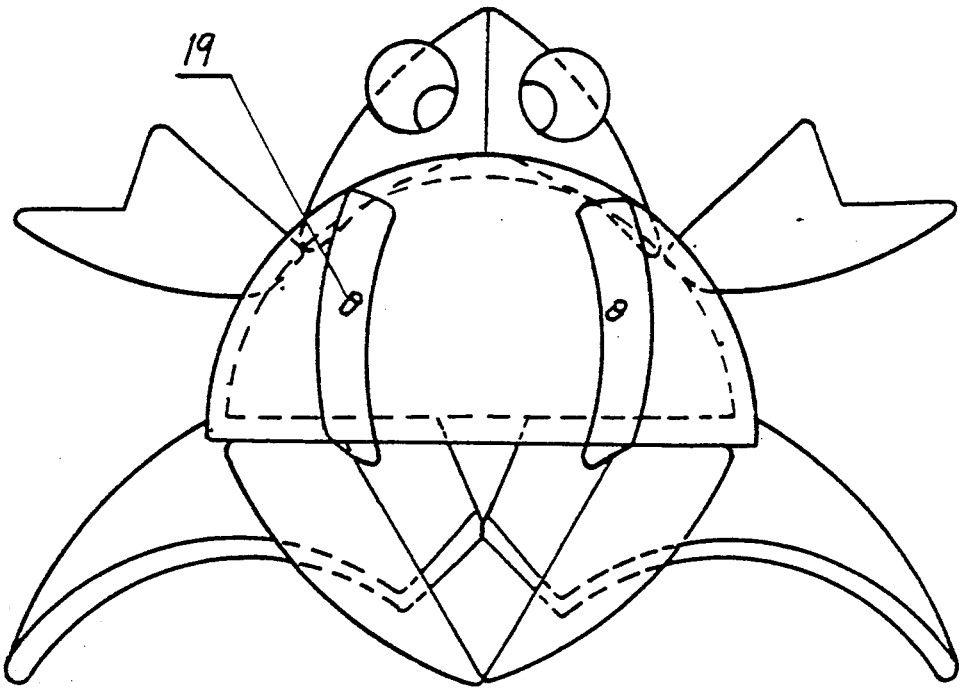

FIG. 10 illustrates a third embodiment, which essential structure is basically similar to that of the first embodiment, the essential difference being that cylinder construction units are added, which diameters are the same as those of circular holes on the other construction units so as to insert-connect two construction units simultaneously to construct more complicated models.

Figure 11:
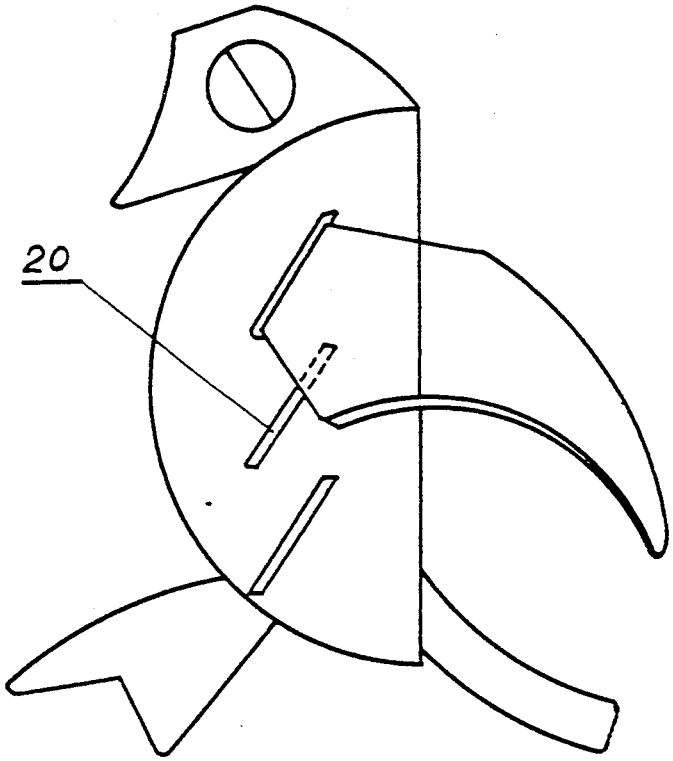

FIG. 11 shows a fourth embodiment, which essential structure is basically similar to that of the first embodiment, the essential difference being that several sections of grooves 20 are arranged on the sides of the meta-element, which are inclined to the straight edge of the meta-element so as to construct an embellished insert connecting toy.

In summary, compared with conventional connection toys, the structure provided by the present invention is thought to be original in conception, ingenious in configuration and convenient in terms of the insert-connecting methodology provided. According to the invention, several animal models can be constructed, which can also be used as ornaments. All construction units in the present invention can be made of engineering plastics by injection, moulding, which is suitable for large scale production.

We claim:

1. An insert-connecting toy comprising a plurality of irregular construction units, wherein said construction units are divided into at least one meta-element and one or more sub-elements; the thicknesses of the thinnest sub-element being a predetermined unit thickness, and the thicknesses of the other sub-elements each being an integer number times the unit thickness; a plurality of alternating grooves and lands being arranged on said meta-element, the width of each of said grooves and lands being an integer number times said unit thickness; and a plurality of additional alternating grooves and lands being arranged on at least one of the sub-elements, and the width of each of said grooves and lands also being an integer number times the unit thickness, whereby said additional alternating grooves and lands are adapted to interconnect respective ones of said lands and grooves of said meta-element for forming multiple insert-connection models, wherein each construction unit and at least one of the lands being provided with an edge chamfered by circular bead, and the cross-section of the groove is trapezoidal, and wherein tenoning surfaces of said construction units are arranged with minute circular bosses.

2. An insert-connecting toy as claimed in claim 1, wherein the grooves on the meta-element are linear and the grooves on at least one of the sub-elements with grooves are also linear.

3. An insert-connecting toy as claimed in claim 1, wherein the grooves and lands on the meta-element are linear and disposed in a predetermined plane, and the grooves and lands on at least one of the sub-elements with grooves are also linear and disposable in a plane adjacent to said predetermined plane.

4. An insert-connecting toy as claimed in claim 1 or 2 or 3, wherein on at least one construction unit, a circular hole is arranged, and simultaneously on at least one other construction unit a circular boss with diameter that is the same as that of said hole is arranged.

5. An insert-connecting toy as claimed in claim 4, further comprising at least one compound sub-element which is formed by two interconnected sub-elements.

6. An insert connecting toy as claimed in claim 5, further comprising at least one cylinder construction unit, with diameter that is the same as that of the hole on the at least one construction unit.

* * * * *